US006882704B2

(12) United States Patent
Schriever et al.

(10) Patent No.: US 6,882,704 B2
(45) Date of Patent: Apr. 19, 2005

(54) RADIATION SOURCE FOR GENERATING EXTREME ULTRAVIOLET RADIATION

(75) Inventors: Guido Schriever, Goettingen (DE); Kai Gaebel, Jena (DE); Uwe Stamm, Goettingen (DE)

(73) Assignee: Xtreme technologies GmbH, Jena (DE)

( * ) Notice: Subject to any disclaimer, the term of this patent is extended or adjusted under 35 U.S.C. 154(b) by 0 days.

(21) Appl. No.: 10/697,579

(22) Filed: Oct. 30, 2003

(65) Prior Publication Data

US 2004/0135517 A1 Jul. 15, 2004

(30) Foreign Application Priority Data

Oct. 30, 2002 (DE) ..... 102 51 435

(51) Int. Cl.[7] ..... H05H 35/00

(52) U.S. Cl. ..... 378/119; 372/57; 156/345.38; 315/111.71

(58) Field of Search ..... 315/111.01, 111.81; 378/34, 119–123, 210; 372/57, 82; 37/59; 156/345.38, 345.48, 345.5

(56) References Cited

U.S. PATENT DOCUMENTS

| | | | | |
|---|---|---|---|---|
| 5,991,360 A | | 11/1999 | Matsui et al. | 378/119 |
| 6,002,744 A | | 12/1999 | Hertz et al. | 378/119 |
| 6,018,537 A | | 1/2000 | Hofmann et al. | 372/25 |
| 6,243,405 B1 | * | 6/2001 | Borneis et al. | 372/57 |
| 6,304,630 B1 | | 10/2001 | Bisschops et al. | 378/119 |
| 6,343,089 B1 | * | 1/2002 | Manos et al. | 372/82 |
| 6,549,555 B1 | * | 4/2003 | Serwazi et al. | 372/59 |
| 6,610,169 B1 | * | 8/2003 | Nguyen et al. | 156/345.38 |
| 2002/0094063 A1 | | 7/2002 | Nishimura et al. | 378/119 |

FOREIGN PATENT DOCUMENTS

| | | |
|---|---|---|
| DE | 39 27 089 | 4/1991 |
| DE | 102 15 469.4 | 4/2002 |
| DE | 102 37 901.7 | 8/2002 |
| EP | 1 109 427 | 6/2001 |
| EP | 1 170 892 | 1/2002 |

* cited by examiner

*Primary Examiner*—Wilson Lee
(74) *Attorney, Agent, or Firm*—Reed Smith LLP

(57) ABSTRACT

The invention is directed to a radiation source for generating extreme ultraviolet (EUV) radiation, particularly for photolithography exposure processes. The object of the invention is to find a novel possibility for realizing radiation sources for generating extreme ultraviolet (EUV) radiation which permits a uniform basic construction for ensuring beam characteristics that are reproducible over the long term and in which the source is conceived so as to be flexible with respect to specific applications. This object is met according to the invention in that any plasma generation unit is provided for introducing high energy input supplied in a pulsed manner in a vacuum chamber, and the radiation generated from the plasma is monitored by an energy monitor unit which measures the pulse energy of the emitted radiation and by a radiation diagnosis unit which detects the radiation characteristics to obtain result data for influencing the excitation conditions for the plasma and to influence the parameters of the plasma generation in an application-specific manner by means of the main control unit.

30 Claims, 5 Drawing Sheets

RADIATION SOURCE FOR GENERATING EXTREME ULTRAVIOLET RADIATION

CROSS-REFERENCE TO RELATED APPLICATIONS

This application claims priority of German Application No. 102 51 435.6, filed Oct. 30, 2002, the complete disclosures of which are hereby incorporated by reference.

BACKGROUND OF THE INVENTION a) Field of the Invention

The invention is directed to a radiation source for generating extreme ultraviolet (EUV) radiation, particularly for photolithography exposure processes. It is preferably applied in the semiconductor industry for the fabrication of semiconductor chips with structure widths of less than 50 nm.

b) Description of the Related Art

Gas discharge plasmas and laser-induced plasmas are known as emitters of EUV radiation. Different applications of this radiation are currently under examination, e.g., lithography, microscopy, reflectometry and surface analyses. Intensive, dependable radiation sources are required for all of these different applications.

EUV radiation sources will be required in the future primarily in the semiconductor industry for exposing very small structures in lithography processes in order to be able to produce structure widths of less than 50 nm with very good reproducibility with a high throughput of semiconductor wafers.

At the present time, EUV radiation sources are built as prototypes. The individual structural component parts are brought into line with one another predominantly in a function-oriented manner. It is difficult to exchange components in a source that is conceived in this way and compatibility with other applications is impossible. However, there is also a demand for maintaining stable radiation characteristics throughout the duration of operation as well as for inexpensive exchange of defective or worn components.

Similar problems are addressed in U.S. Pat. No. 6,018,537 for reliable series production of excimer lasers. In this case, a 10-mJ-$F_2$ laser with a pulse rate of 1–2 kHz is constructed in such a way that determined control modules are associated with the units of the radiation source which essentially determine the radiation output and repetition rate of the laser. Apart from the general task of controlling or regulating certain influencing variables of the laser, these control modules can not be adopted for the complicated control functions of a EUV radiation source.

OBJECT AND SUMMARY OF THE INVENTION

The primary object of the invention is to find a novel possibility for realizing radiation sources for generating extreme ultraviolet (EUV) radiation which permits a uniform basic construction for ensuring beam characteristics that are reproducible over the long term and in which the source is conceived so as to be flexible with respect to specific applications.

The object of the invention, to generate EUV radiation, wherein a hot plasma emitting the desired radiation is generated in a vacuum chamber, is met according to the invention by a radiation source comprising a plasma generation unit which is directly connected with the vacuum chamber for introducing high energy input which is supplied in a pulsed manner in order to generate hot plasma in a small spatial extension and with high density in an axis of symmetry of the vacuum chamber, wherein the vacuum chamber has an outlet opening for coupling out a light bundle for a specific application, a vacuum generation unit for generating a diluted gas atmosphere at defined pressure in the vacuum chamber and portions of the plasma generation unit, wherein the vacuum generation unit has at least one vacuum pump, a pressure measuring device and a control for maintaining a suitable operating pressure for the generation of plasma and EUV radiation, an energy monitor unit for detecting the pulse energy of the emitted radiation, wherein the energy monitor unit has a feedback to the energy input for regulating a pulse-to-pulse stability of the energy emission of the plasma, a radiation diagnosis unit for analyzing the actual radiation characteristic of the radiation emitted from the plasma and generating result data of the diagnosis for influencing the excitation conditions for the plasma, and a main control unit for controlling a defined quality of the coupled out light bundle as radiation pulses of application-specific pulse duration, pulse repetition rate, average energy emission and radiation intensity, wherein the main control unit has interfaces to all of the above-mentioned units of the radiation source in order to detect and, when required, influence at least their state of adjustment, and operator controls are provided for application-specific control in order to influence the radiation source depending upon transmitted status data, diagnosis data and application requirements that are entered.

The energy monitor unit preferably contains a detector for determining the EUV pulse energy for every individual pulse. In order to be able to measure energy values that are extensively free from degradation effects in the detector (and on mirrors, as the case may be), the energy monitor unit advantageously has an additional, second detector for determining the absolute EUV pulse energy which is illuminated only occasionally for comparison measurements in relation to the radiation emitted from the plasma and is provided for calibrating the first detector. A comparison of the read-out energy values of the first and second energy detectors allows the measurement values to be calibrated to absolute values. Since the second energy detector is used only rarely and briefly for calibration and is concealed the rest of the time, the degradation of the second detector caused by the impinging radiation is minor and the absolute calibration of the energy monitor unit is retained for a long period of time. Further, the energy monitor unit is used to achieve a reproducible, absolute radiation dose in the application. The radiation dose is calculated from the product of the pulse number and pulse energy by summing the energies of the individual pulses of a burst (i.e., succession of radiation pulses with fixed repetition rate). A discrepancy between the reference value and the actual value resulting from pulse-to-pulse fluctuations in pulse energy can be compensated by regulating the pulse energies within the burst. For this purpose, the main control unit calculates the actual dose relative to the required dose from the calibrated energy values of the first energy detector. The quantity of the energy input for plasma generation is regulated in the plasma generation unit.

The radiation diagnosis unit can advisably have a spectrograph for determining the spectral distribution of the emitted radiation. The spectrograph is preferably supplemented by an additional calibration detector for determining the output energy or power of the EUV radiation source. However, the function of the calibration detector can also be taken over by the detectors of the energy monitor unit.

In another advantageous arrangement, the radiation diagnosis unit has a plurality of sensors of different spectral sensitivity. The light yield is measured in defined spectral intervals. For this purpose, the radiation diagnosis unit is preferably provided with a plurality of photodiodes with different edge filters and the light yield can be determined in defined spectral intervals by differentiation of measured intensity values of the photodiodes with different filters. A superproportional increase in the infrared component of the emitted radiation can indicate an excessively high electrode temperature in gas discharge plasmas, wherein the electrodes emit increased infrared radiation through incandescence. A brief pause in operation lowers the electrode temperature and accordingly reduces the proportion of infrared radiation. A similar effect in laser-induced plasmas due to the incandescence of the target system can be reduced by means of the same step. The radiation diagnosis unit advisably also has means for determining and comparing the measured radiation components within the desired EUV spectral region (in-band) and outside the desired EUV region (out-of-band); the constitution or quality of the plasma can be analyzed and adjustment variables for the plasma generation unit can be derived by comparing the intensity values of individual spectral intervals to one another. A shift of the maximum in the spectral distribution from the EUV range to the longer wavelengths is a sign of reduced efficiency in the generation of the EUV radiation and indicates a lower temperature of the generated plasma. In a plasma generation unit based on gas discharge, this phenomenon can be countered by applying a higher voltage to the electrodes or by reducing the pressure of the work gas. In laser-induced plasma generation, the temperature of the plasma is achieved by increasing the laser pulse energy or by focusing the laser radiation on a smaller spot.

An EUV-sensitive camera is advantageously contained in the radiation diagnosis unit in order to be able to determine the size and position of the source location of the radiation in the plasma more precisely. Further, the camera can be combined with an imaging optical system, preferably a reflecting multilayer mirror system, for determining the angular distribution of the EUV radiation which is generated by the plasma and exits from the vacuum chamber. In gas discharge sources, the shifting of the source location points to a deformation of the electrodes through erosion; the source location can be shifted back to its original location by timely renewal of the electrodes. It is better to plan ahead for the required maintenance work and adapt it to the operating periods of the radiation source in the measuring process or production process. With laser-induced plasma, a change in the position of the source location is indicative of a shift in the laser focus. This is tracked in a suitable manner or, for example, adjusted back to the original position by using an autofocus system.

Further, a fast EUV detector with response times of a few nanoseconds (or less) is advantageously used in the radiation diagnosis unit for determining the pulse shape of the emitted radiation. At least one additional fast EUV detector is advisably provided for purposes of recalibrating the first fast EUV detector. A long emission period is advantageous for a good emission yield because the pulse energy given by the integral of the intensity over time is greater with the coupled-in energy remaining the same. Suitable selection of the components in the electrical discharge circuit of a gas discharge source makes it possible to adapt so that the emission duration is at a maximum. With laser-based plasma generation, maximum pulse duration is already fixed by the selection of the construction and type of laser.

In a first advantageous basic variant, the plasma generation unit contains a high-voltage module for generating a high voltage for gas discharge and a discharge module with electrodes that are suitably shaped for a through-flow of gas, wherein a pulsed application of voltage to the electrodes is provided as energy input for plasma generation, and has a gas supply module for the flow of gas through the electrodes which provides a work gas in the vacuum chamber in a suitable composition for plasma generation.

The high-voltage module advisably contains a capacitor bank which can be charged in short periods of time and discharged by means of a switching element and an electric circuit via the electrodes of the discharge module. Magnetic compression stages for reducing current rise times and additional capacitor banks can be integrated in the high-voltage module.

The high-voltage module advisably communicates with the main control unit with respect to the adjustment of voltage and charging speed. A triggering of the high-voltage module is provided for determining the time of discharge by means of an external signal of the main control unit.

A gas recycling module is advantageously provided for reducing the requirement for work gas for the gas discharge; this gas recycling module is connected to the vacuum generation unit for receiving and delivering gas pumped out of the vacuum chamber and communicates with the gas supply module.

To initiate the gas discharge, the discharge module advisably has two concentrically arranged electrodes which are separated from one another by an insulator disk for a plasma focus discharge, as it is called.

Another, equivalent electrode arrangement for realization in the discharge module comprises two oppositely located electrodes which are designed for a Z-pinch discharge and are separated by an insulator tube. This electrode arrangement can be modified to form a construction suitable for a capillary discharge by reducing to a very small inner diameter of the insulator tube.

Further, in another arrangement of the electrodes for plasma generation, two oppositely located electrodes are provided in the discharge module, and the cathode has a cavity in which the plasma ignition takes place; this arrangement is known as a hollow cathode triggered pinch discharge.

In a second basic variant of the radiation source, the plasma generation unit advantageously has a laser module by which the plasma is generated by laser bombardment of a target in the vacuum chamber and which is outfitted with control components for self-regulation of the laser based on a laser beam control and a controllable target generator module which is provided for generating a target flow for the laser bombardment that is defined with respect to aggregate state, temperature and shape.

The laser module advisably contains a device for laser beam diagnosis which involves measurement of the output energy and pulse energy of the laser beam. In addition, a focusing device for the laser beam, particularly an autofocus device, can be assigned to the laser module.

For the constructional variant of laser-induced plasma generation, an optical element is advisably arranged as collector optics for bundling the radiation emitted from the plasma. The collector optics comprise a curved multilayer mirror and are arranged in such a way that the usable intensity of the light bundle exiting from the outlet window is increased.

It is advisable to provide a debris filter unit for absorption of particles that are emitted from the plasma with the desired radiation. A debris filter is arranged between the plasma and optical elements of collector optics which are provided for shaping and bundling the radiation exiting from the outlet opening of the vacuum chamber.

In order to reduce the consumption of target material, the vacuum generation unit is advantageously incorporated in a target recycling module. A collecting device for target residues which are sucked out via compressors is arranged in the vacuum chamber opposite the target generator module and the outputs of the compressor and vacuum generation unit are connected to the target generator module for returning unused target material.

In every basic variant of the radiation source, the vacuum generation unit has a link to the main control unit by which an adjustment of the required pressure is provided for the plasma generation in the vacuum chamber.

In an advantageous construction, the main control unit contains all controls and regulation for all units and modules; corresponding data interfaces are provided for transferring measurement values and adjusting values in order to monitor all functions and states of the radiation source and control them in a coordinated manner.

Alternatively, the main control unit can also provide only application-oriented control functions for the units and modules of the radiation source and can have means for monitoring damage and disturbance, wherein all units and modules contain their own control systems and regulation systems which have data communication with the main control unit.

The invention makes it possible to realize a radiation source for generating extreme ultraviolet (EUV) radiation which permits a uniform basic construction with application-specific flexibility of the source concept for ensuring radiation characteristics which are reproducible over the long term.

In the following, the invention will be described in more detail with reference to embodiment examples.

DESCRIPTION OF THE PREFERRED EMBODIMENTS

Figure 1:
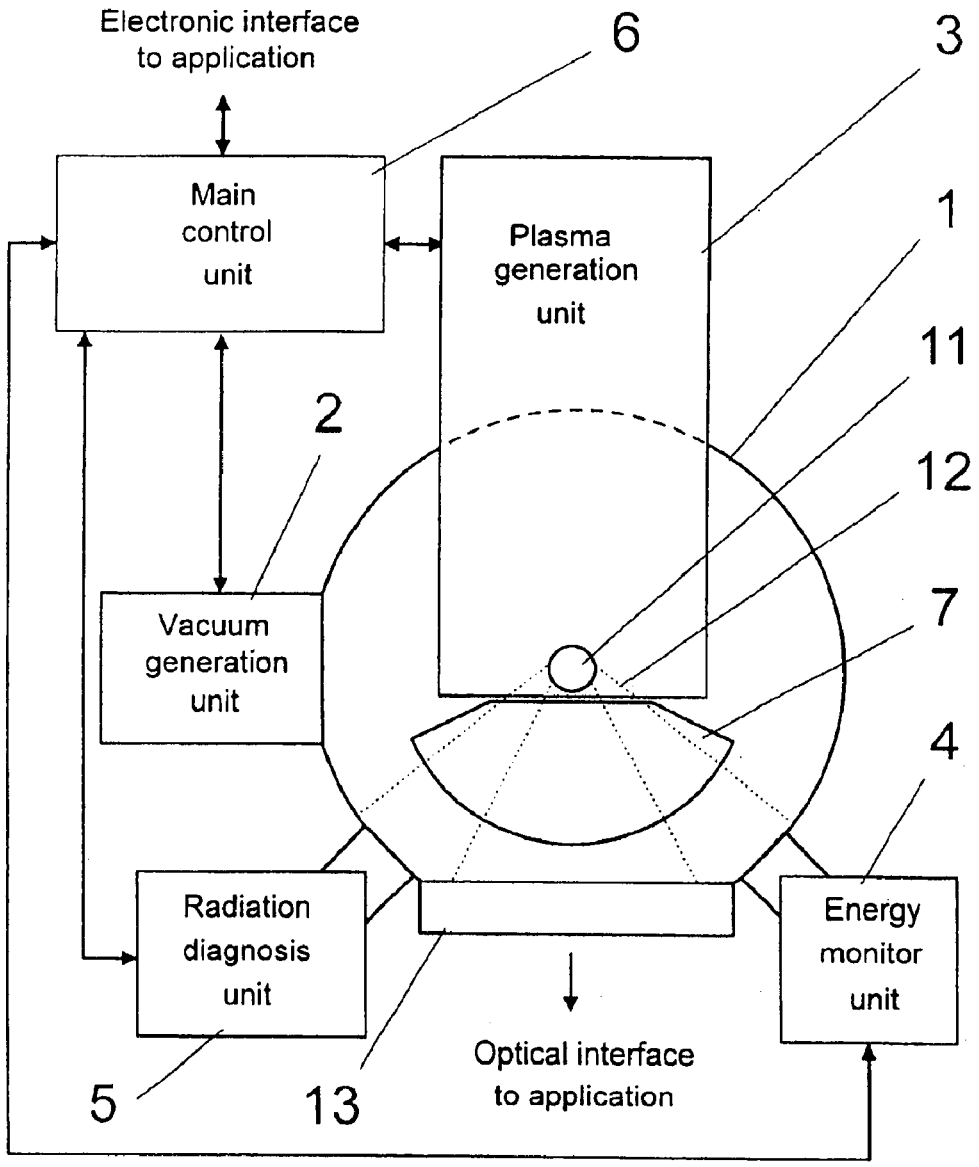
FIG. 1 shows the basic construction of an EUV radiation source according to the invention which is not dependent on the principle of plasma generation.

In its basic construction—as is shown schematically in FIG. 1—the radiation source according to the invention comprises a vacuum chamber 1 for the generation of plasma 11. A vacuum generation unit 2 for adjusting a defined low internal pressure (vacuum) is connected to the vacuum chamber 1. The radiation source further comprises a plasma generation unit 3 for generating a dense, hot plasma 11, an energy monitor unit 4, a radiation diagnosis unit 5, and a main control unit 6 for adjusting and monitoring the stable and reproducible operation of the units mentioned above.

Depending upon the intended purpose of the application and on the manner in which the plasma is generated, the composition of the radiation source from different units or modules can be further specialized and expanded in quantity or can also be composed with other considerations in mind. Without limiting generality, the following description is based on a defined monitoring and controlling structure of the EUV radiation source in order to ensure compatibility with different application requirements and a sufficient stability of the radiation parameters over its entire useful life.

The plasma generation unit 3 which is described more specifically in the following generates a dense, hot plasma 11 in the vacuum chamber, which plasma 11 emits extreme ultraviolet radiation 12 to a considerable extent with suitable control of the plasma generation. In order to generate and maintain a defined low pressure, a vacuum generation unit 2 containing vacuum valves and pressure sensors (e.g., pressure measuring tubes) in addition to one or more vacuum pumps is connected to the vacuum chamber 1.

Due to the mechanical limitation of the outlet opening 13 as optical interface for the application, the emitted radiation 12 is usable only in a limited solid angle for the application. With this in mind, steps serving to protect optically active surfaces or optoelectronically sensitive materials are limited to this solid angle and a small area surrounding it. Since the plasma generates not only the intended particles but also charged and neutral particles which adversely affect, for example, the reflection characteristics of mirrors and the sensitivity of detectors, a debris filter unit 7 which retains such particles is arranged in this solid angle of the radiation 12. The radiation 12 is generally not conducted through filter layers—in contrast to optical filters—since these filter layers also do not act stably over long periods of time and also unnecessarily weaken the desired EUV radiation. The debris filter 7 is therefore based on adhesion effects or flow effects or a combination thereof and on superposition with electric and/or magnetic fields. Suitable debris filters for this purpose are described, for example, in patent applications DE 102 15 469.4 and DE 102 37 901.7 (not published beforehand), the solution presented in the latter reference being shown schematically in FIG. 1.

In order to obtain suitable control signals for the plasma generation unit 3, at least detectors or sensor modules of the energy monitor unit 4 for measuring the energy of the radiation 12 emitted from the plasma 11 and the radiation diagnosis unit 5 for analyzing the radiation characteristic are arranged in the immediate vicinity of or directly in the limited solid angle of the radiation 12. Using the measurements derived therefrom, the conditions for the formation of the plasma in the vacuum generation unit 2 and the plasma generation unit 3 are checked and readjusted (controlled) if necessary by the main control unit 6.

The vacuum generation unit 2 and plasma generation unit 3 have at least in part their own controls which communicate respectively with the main control unit 6. The main control unit 6 uses the input signals (adjustment variables) of the individual units or their controls or control loops to maintain constant characteristics of the radiation source and to stabilize all parameters within the given value ranges. Further, the main control unit 6 has an electronic interface for the application and can take the form of a control terminal by means of which certain application-specific adjustments of parameters can be changed by means of an operating surface (not shown). To this extent, the main control 6 also influences basic adjustments of parameters of the controls of the vacuum generation unit 2 and the plasma generation unit 3.

In the following the units and modules of the EUV radiation source according to the invention are described more fully in two examples for different concepts of the plasma generation.

EXAMPLE 1

Radiation Source Based on Gas Discharge Plasma

There are many known constructions of EUV radiation sources based on gas discharges, in all of which a high voltage generated in a pulsed manner in a work gas under low pressure discharges by means of rotationally symmetric electrodes. As a result of the occurring high current densities, the discharge plasma implodes to form a hot plasma within a very limited space.

Figure 2:
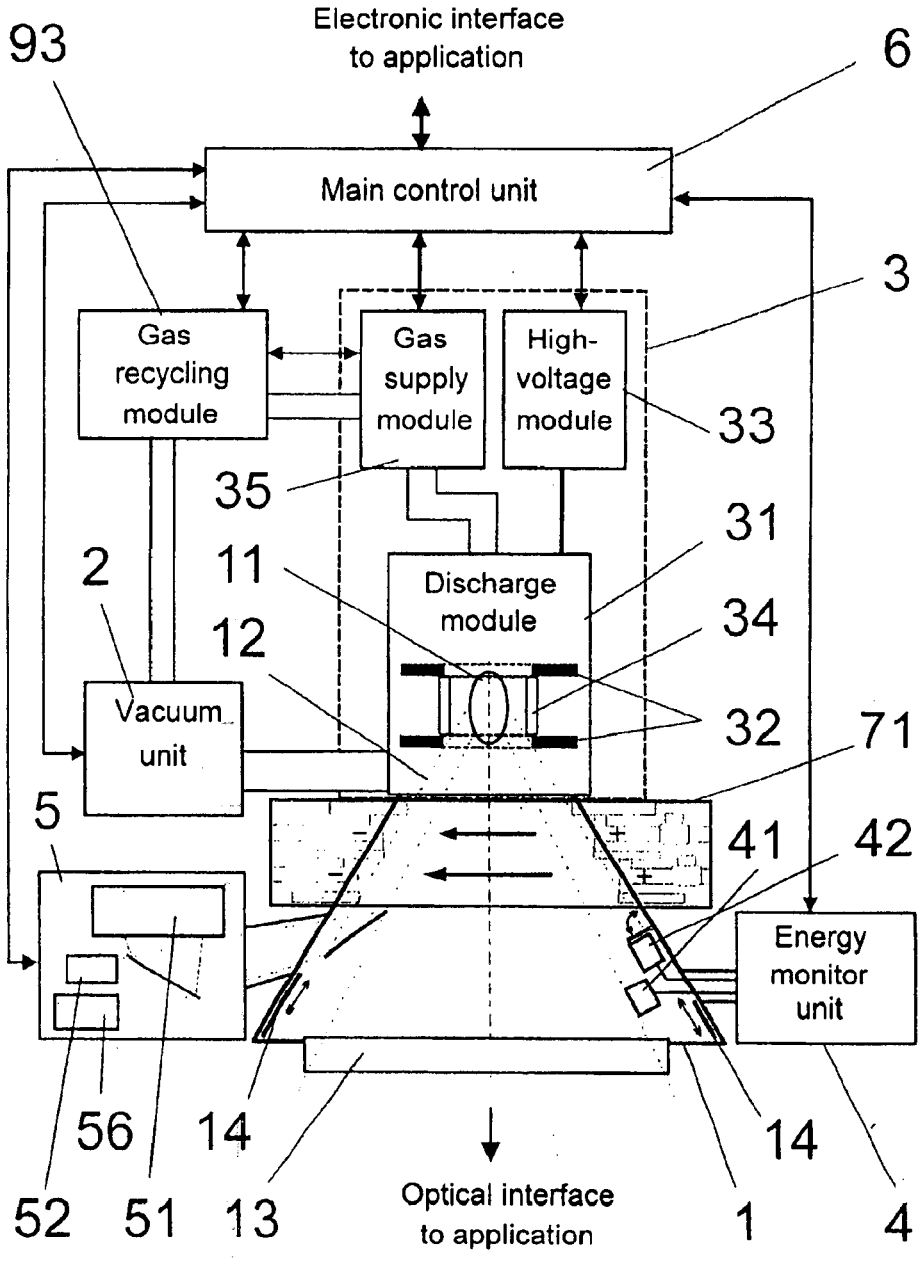
FIG. 2 shows a variant arrangement for an EUV radiation source based on a gas discharge.

For gas discharge of the kind mentioned above, the plasma generation unit 3 according to FIG. 2 has a discharge module 31 with electrodes 32 which are suitably shaped for through-flow of gas, a high-voltage module 33 for generating the required high voltage and for gas flow through the electrodes 32, and a gas supply module 35 which provides a work gas (e.g., containing a substantial proportion of a rare gas, preferably xenon) in a vacuum chamber 1 in a composition suitable for plasma generation.

The high-voltage module 33 has a capacitor bank which can charge quickly and can discharge by means of a switching element and an electric circuit via the electrodes 32 of the discharge module 31. Further, magnetic compression stages for reducing the current rise times and additional capacitor banks can be integrated in the high-voltage module 33.

The high-voltage module 33 communicates with the main control unit 6 with respect to voltage and charging speed. A triggering of the high-voltage module 33 is provided for determining the time of discharge by an external signal of the main control unit 6.

In order to maintain a low work gas requirement for the gas discharge, a gas recycling module 93 is connected to the gas supply module 35. The gas recycling module 93 communicates with the vacuum generation unit 2 for receiving and providing gas pumped out of the vacuum chamber 1. The work gas can be captured behind a vacuum pump of the vacuum generation unit 2 by means of the gas recycling module 93, cleaned with filters and piped back into a supply reservoir for work gas of the gas supply module 35. This gas recovery minimizes the gas consumption of the radiation source and accordingly reduces operating costs.

Since the gas supply module 35 supplies the required gas flow in the discharge module 31 and accordingly directly influences the pressure control of the vacuum generation unit 2, the gas supply module 35 is closely coupled with the vacuum generation unit 2 in technical respects regarding regulation. According to FIG. 2, however, the mutual influencing by means of the main control unit 6 could just as well take place in direct contact between the vacuum generation unit 2 and gas supply module 35. The adjustment of the required pressure for the plasma generation 1 is controlled by means of the connection between the vacuum generation unit 2 and the main control unit 6 for generating and maintaining the vacuum. At the same time, the pressure in the vacuum chamber 1 is also influenced by the gas supply module 35 in a gas discharge pumped EUV source. Therefore, the main control unit 6 is also connected to it.

The vacuum generation unit 2 comprises vacuum pumps, vacuum valves and pressure sensors (e.g., pressure measurement tubes). These components are controlled by the vacuum generation unit 2 itself or are (at least partly) integrated into the main control unit 6. The necessary pressure in the discharge area of the discharge module 31 is given in every case by the main control unit 6. The measured pressure in the vacuum chamber 1 (or at different locations of the entire vacuum system) and a measured gas flow through a gas inlet for providing the work gas from the gas supply module 35 to the discharge module 31 supply the input signals for the vacuum generation unit 2.

In order to adjust the necessary gas pressure in the vacuum chamber 1, the vacuum generation unit 2 can vary the pump output, the opening of a suction valve (downstream valve) in front of the vacuum pump or the gas flow through the gas inlet by means of a needle valve or a flow meter (MFC=mass flow controller), or a combination of these three possibilities can be selected. The MFC varies given flow rates through an installed valve and measures by utilizing heat conduction effects. On the one hand, the required pressure in the vacuum chamber 1 can advantageously be adjusted by a combination of a needle valve with fixedly adjusted gas flow and a controllable valve which varies the suction power of a vacuum pump by changing the cross section of the suction line. On the other hand, a vacuum pump with fixed pumping capacity can also be used when working with a combination of an electrically controlled needle valve and a measuring device for determining the gas flow based on thermal measuring methods (e.g., in known MFCs).

Slide valves 14 (shown schematically in FIG. 2 and shown only by way of example in the energy monitor unit 4 and radiation diagnosis unit 5) which are arranged at coupling points (flanges) of different modules make it possible to exchange all modules or units while the rest of the components remain under vacuum. This reduces the time required for maintenance work since the entire radiation source need not be evacuated again.

The discharge module 31 which is constructed as a flanged on part of the vacuum chamber 1 for generating the plasma 11 can be realized with very different electrode configurations. It comprises an arrangement of two electrodes 32 and insulators which are arranged therebetween and which separate the electrodes 32 from one another.

As in all gas discharge pumped radiation sources of the kind mentioned above, high-voltage pulses are repeatedly applied to the electrodes 32 in the discharge module 31 under vacuum. The energy stored in the capacitor bank of the high-voltage module 33 is supplied to the electrodes 32 via a low-induction circuit. In all cases, the plasma 11 generated by a gas discharge has similar characteristics such as an electron temperature (thermal energy) in the range of 5–50 eV and a density in the range of $10^{17}$–$10^{20}$ particles/$cm^3$. The geometric arrangement of the electrodes 32 and the shielding insulators of the discharge module 31 is determined by the discharge concept.

A Z-pinch construction with two oppositely located electrodes 32 separated by an insulator tube 34 is shown schematically in FIG. 2. However, two concentrically arranged cylindrical electrodes 32 which are separated from one another by an insulator disk and generate a plasma focus discharge also lead to a similar rod-shaped plasma 11. A capillary discharge is conceived in that the inner diameter of the insulator tube of a Z-pinch construction is constructed so as to be very small. Further, identical plasmas can be achieved by means of a hollow cathode-triggered pinch discharge by two oppositely located concentric electrodes whose cathode has a cavity in which the plasma ignition takes place.

The modular construction given by the vacuum chamber 1 with connected vacuum generation unit 2, plasma generation unit 3 and peripheral measurement units, energy monitor unit 4 and radiation diagnosis unit 5 can be used for all of the arrangements of a discharge module 31 mentioned above and can be modified as desired. Only the discharge module 31 arranged at the vacuum chamber 1 must be changed with correspondingly differently constructed electrodes 32. Suitable above all for this purpose is a vacuum chamber 1 having a cone (frustrum) shape which is shown schematically in FIG. 2 and in which the discharge module 31 is inserted in and flanged to the cover surface of the frustrum and the base surface contains the outlet opening 13 for the radiation 12. However, a spherical shape of the vacuum chamber 1 can also be realized when the discharge module 31 projects into the sphere in order to generate the plasma 11 as close as possible to the center of the sphere. Cylindrical vacuum chambers 1 can also be used under the same conditions.

The energy monitor unit 4 is an essential device for realizing the EUV radiation source with stable radiation output and great stability over the long term. The energy monitor unit 4 measures the energy per radiation pulse. In addition, it can detect the average output power (dose) of the radiation source. It comprises a detector 41 which is provided with a filter for limiting the measured wavelength range. The filter is typically formed by one or more multilayer mirrors which limit the desired wavelength range in the EUV spectral region in the manner of a bandpass filter due to their reflection characteristics. Accordingly, only radiation from the wavelength range that is relevant for the application contributes to the signal. An additional thin metal filter absorbs radiation in the visible, ultraviolet and infrared ranges. The detector 41 is typically a photodiode, a multi-channel plate, a diode array or a CCD camera.

Since the detector 41 of the energy monitor unit 4 is constantly exposed to the radiation emitted from the plasma 11, its characteristics typically change as a result of aging. The reflectivity of the mirrors that are used can likewise change through evaporation and/or ablation of mirror material or due to deposits of particles from the gas phase. The sensitivity of the detector 41 can accordingly decrease due not only to internal electronic degradation but as a result of other aging processes in the environment which are proportional to the emitted dose. Therefore, the energy monitor unit 4 is supplemented by elements which detect the aging effects through monitoring measurements and initiate a correction of these aging effects.

The reflection losses of the mirrors can be determined, for example, by on-line measurements of absorption through calorimetry, since lower reflectivity of the mirrors leads to a higher absorption and a consequent increase in temperature. The degradation of the detector 41 is measured by repeated measurements by means of new mirrors and comparison to the original signal. For this purpose, a second energy detector, recalibration detector 42, is installed in the energy monitor unit 4 and is masked during normal operation by a mechanical arrangement of the source location (plasma 11) of the radiation 12. The recalibration detector 42 is switched on occasionally (e.g., once a day) and operated simultaneous with the first detector 41. The signals of the two energy detectors 41 and 42 are compared and a calibration of the first detector 41 is carried out.

The signal of the detector 41 of the energy monitor unit 4 is used by the main control unit 6 accompanied by application of suitable calibrating factors for determining the output power of the radiation source. The main control unit 6 selects the suitable parameters for discharge from the calibration factors in order to stabilize the output power in the required value range.

A radiation diagnosis unit 5 is provided as another essential measuring device for controlling the EUV radiation source in order to determine the radiation characteristics of the plasma 11. It represents a combination of different measuring modules which are described in the following and which can be combined with one another relatively freely and independent from one another; however, the first two are to be considered as necessary:

a spectrographic module for determining the spectral distribution of the radiation;

an EUV camera which determines the source quantity and its position;

an imaging system for determining the angular distribution of the radiation;

a fast EUV detector for determining the pulse shape of the emitted radiation.

The spectrographic module can contain a conventional spectrograph 51 as shown in FIG. 2. This spectrograph 51 can be used in addition to determine the output energy or output power of the EUV source insofar as it is calibrated by an internal EUV detector 52 or the energy monitor unit 41 of the radiation source. The spectrograph 51 is essentially provided for determining the emitted radiation in the usable EUV wavelength range (in-band radiation) and the emitted radiation which does not lie in the desired EUV wavelength region (out-of-band radiation). The change in the temperature of the plasma 11 is worked toward by evaluating the ratio of in-band radiation components to out-of-band radiation components. The plasma temperature is too high when the maximum of the emission is shifted to shorter wavelengths and too low in the longwave spectral region. The plasma temperature can be increased by depositing more energy in the plasma. The discharge voltage is increased in a gas discharge plasma and the laser intensity is increased in laser-induced plasma.

Figure 3:
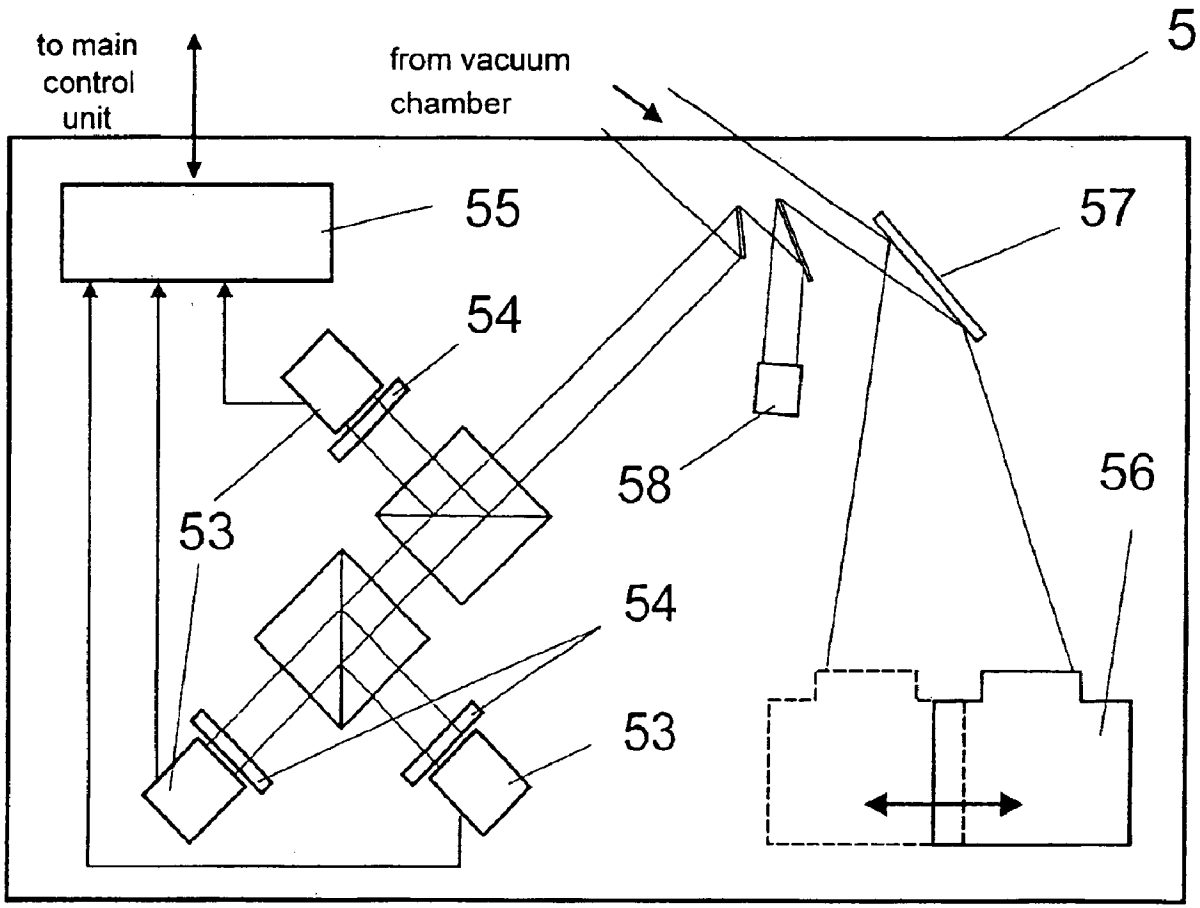
FIG. 3 shows a particularly advantageous construction of the radiation diagnosis unit with individual spectral sensors and EUV camera for angle-dependent measurements.

As is shown in schematically in FIG. 3, an arrangement of a plurality of spectrally selective sensors 53 can be installed as a spectrographic module in the radiation diagnosis unit 5 in an economical and space-saving manner and so as to be adapted specifically to user requirements. The different spectral sensitivity of the sensors 53 is selected through combinations of photodiodes with different spectral filters 54 which are transparent only for radiation in determined spectral regions (outside the desired EUV wavelength region).

Sensors 53 for out-of-band radiation can comprise, e.g., a photodiode (or other power measuring device) behind a calcium fluoride window, so that the radiation 12 can be detected in the wavelength range above 130 nm. Additional sensors 53 can be realized by using other filters 54 in combination with additional photodiodes (or other power measuring devices). Materials for filters 54 of the type mentioned above and the wavelength regions detectable behind them are listed in the following table:

| Filter Material | Transmitted Wavelengths |
|---|---|
| glass | >400 nm |
| calcium fluoride | >130 nm |
| aluminum | approximately 17–70 nm |
| niobium | approximately 6–16 nm |
| silicon nitride or silicon | approximately 12–18 nm |
| beryllium | approximately 11–25 nm |

The proportions of radiation 12 in determined wavelength intervals can be determined by differentiation of the signals from sensors 53 with different filters 54 in an evaluating module 55 which is integrated in the radiation diagnosis unit 5 according to FIG. 3 but which can also be a component part of the main control unit 6. For example, the differential signal of a sensor 53 behind glass and a sensor behind calcium fluoride gives the radiation output of the plasma 11 in the wavelength range from 130 nm to 400 nm.

When the EUV radiation source is to be used, e.g., for application with an optical precision beam path, the position of the plasma 11 must be constantly checked for reproducible radiation generation. Therefore, in order to determine the source location of the radiation 12, there is an EUV camera 56 in the radiation diagnosis unit 5 which can be constructed as a pinhole camera or—as is shown in FIG. 3—is used in combination with imaging optic 57 as a reflecting multilayer mirror.

Spatial shifting of the plasma 11 can be brought about particularly by consumption of the electrodes 32 and must be compensated by adjustment in the outlet opening 13 of following optical systems (not shown). Therefore, the use of an EUV camera 56 for determining the position of the plasma 11 is indispensable. Using the known imaging scale of the EUV camera 56, it is also possible and useful to determine the source size and position stability of the plasma 11. Since optics following the outlet opening 13 in the beam path for the EUV radiation are tailored to a determined size and position of the emission region, these parameters of the radiation source must be maintained as constant as possible. An emission volume that is too large enlarges the etendue of the source (product of source size and emission angle) and leads to higher losses in the optical system of the application, In this case, optics following the outlet opening 13 can be readjusted or, in case of a laser-based radiation source, the laser module 36 is suitably readjusted with the associated focusing module 38 by the control functions of the main control unit 6.

Further, the angular distribution of the radiation 12 can be determined with the additional imaging optics 57 in front of the EUV camera 56. For this purpose, the described EUV camera 56 must carry out measurements behind the additional optics 57 successively in time at different angles (by displacement of the receiver surface of the EUV camera 56). The angular distribution of the radiation 12 can be determined by evaluating a plurality of recordings. Inhomogeneities in the angular distribution compulsorily lead to inhomogeneities in the illumination plane of the application and must consequently be avoided. They are generated by irregular electrode consumption (in gas discharge plasmas) or by off-center orientation of the laser beam in relation to the target (in laser-induced plasmas). This can be remedied by exchanging the electrodes or adjusting the laser radiation or target system.

Another useful added device for the radiation diagnosis unit 5 is a fast EUV detector 58 which allows the pulse shape of the emitted radiation 12 to be determined with response times of a few nanoseconds or less (e.g., some 100 ps). Additional fast EUV detectors (not shown) can be provided for purposes of recalibration of the first EUV detector 58. While electric circuits and discharge parameters in the high-voltage module 33 determine the pulse shape in gas discharge plasmas according to FIG. 2, the intensity curve over time essentially follows the laser intensity in laser-induced plasmas according to FIG. 4. The energy conversion and, therefore, the efficiency of the EUV source can be increased by lengthening the emission time due to the variation in the influencing variables mentioned above.

In order to protect the optical and optoelectronic components of the energy monitor unit 4 and radiation diagnosis unit 5 as well as optical elements following the latter such as collector optics (not shown in FIG. 2) for shaping a light bundle of radiation 12 exiting the outlet opening 13 for the application, a debris filter unit 7 for absorbing the particles emitted with the radiation 12 from the plasma is arranged directly following the discharge module 31 inside the vacuum chamber 1 which is preferably conical (in the shape of a frustrum) for a gas discharge pumped EUV source. The debris filter unit 7 is constructed in this example according to FIG. 2 as a flow filter 71 based on the principle of electrically assisted cross-flow (e.g., DE 102 15 469). However, any other debris filter configurations can be selected, e.g., also the dome-shaped debris filter 72 described in the following example according to FIG. 4.

On one hand, the main control unit 6 defines an interface between the entire radiation source and the user or application (e.g., lithography exposure machine). On the other hand, the main control unit 6 has interfaces for communicating with the controls and control loops or regulating circuits of all other modules and units of which the radiation source is composed, or it directly influences the actuating members of the units and modules. By evaluating the arriving signals and with knowledge of the characteristics of the radiation source (characteristic lines) and application-specific presets, the main control unit 6 can determine the parameters of the EUV source and convey control signals to individual modules.

In particular, the main control unit 6 controls the repetition rate of the discharges in the discharge module 31 which is predetermined externally by the user or application or is internally adjusted. Application-related presets for the output power of the radiation source, the pulse energy or the emitted radiation dose can be maintained constant by the main control unit 6 by controlling or regulating the individual modules and units in a corresponding manner. For example, the high voltage in the high-voltage module 33 can be held constant at a value which is predetermined by the main control unit 6 through an internal control of the high-voltage module 33. Further, the charging voltage and charging speed of the high-voltage module 33 are predetermined by the main control unit 6. In order to determine the time of discharge, a switch located between the capacitor bank in the high-voltage module 33 and the electrodes 32 in the discharge module 31 is triggered by an external signal of the main control unit 6.

EXAMPLE 2

Laser-Pumped EUV Radiation Source

In this example, a laser beam producing the required energy input for plasma excitation is directed to a target flow in order to generate the EUV-emitting plasma 11. However, other high-energy radiation, e.g., an electron beam, is equally suitable for generating the plasma.

Figure 4:
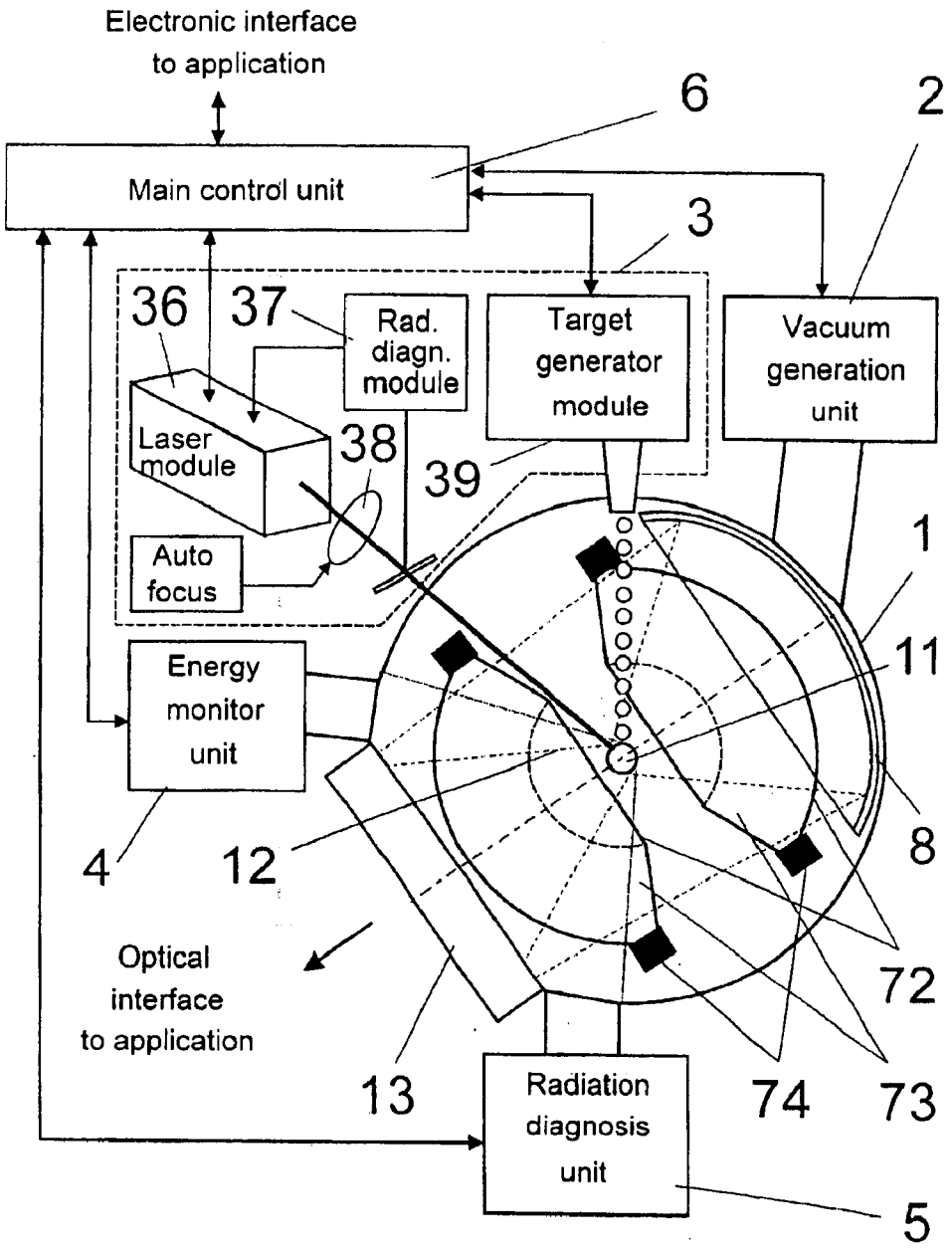
FIG. 4 shows an advantageous arrangement of a laser-based EUV radiation source.

In the laser-pumped radiation source shown in FIG. 4, a laser module 36 containing a pulsed laser which emits pulses with lengths of between 50 fs and 50 ns is provided in the plasma generation unit 3. The pulse energy of laser modules 36 of this kind is typically between 1 mJ and 10 J per pulse.

The wavelength and pulse energy of the laser beam are determined by parameters of the laser module 36 and an internal control. The pulse energy can be varied by pump output, variation of attenuators, etc. The laser module 36 determines suitable parameters of the laser by means of the control and checks that the required specifications are maintained in relation to output power, pulse-to-pulse regulation, repetition frequency, etc.

The plasma generation unit 3 contains an internal beam diagnosis module 37 by means of which the laser beam is analyzed. For example, a partial beam can be coupled out of the beam path at the output of the laser module 36 by means of a partially transparent mirror and conducted into the beam diagnosis module 37. The pulse energy, average laser output, divergence angle of the laser beam, beam profile and beam position stability are all determined therein. These parameters are transmitted to the control of the laser module 36 and compared to the reference values. The control of the laser module 36 determines new laser parameters for the next laser pulse from the deviations and autonomously checks that these parameters are maintained.

To generate a hot, dense plasma 11 from a target, the laser beam must be focused in order to achieve sufficient laser intensity. The position and size of the focus are determined by the focusing means in conjunction with the laser parameters. An autofocusing device 38 ensures uniform characteristics of the focusing for every laser pulse, which results in constant intensity and laser spot size of the laser beam on the target.

In the vacuum chamber 1, the laser beam is directed to a target flow which is generated by a target generator module 39 and intersects the direction of the laser beam.

The target generator module 39 provides the target flow along an axis of symmetry of the vacuum chamber 1. A cylindrical vacuum chamber 1 is preferably used, the laser module 36 and the outlet opening 13 being coupled to its outer surface for application of the emitted radiation, and the target material is supplied and removed at its cover surfaces. The quantity of target material must be sufficient to make available enough radiation generators. For this purpose, the beam diameter of the laser beam and target size must be adapted to one another in such a way that the highest possible conversion efficiency is achieved. The target material may be solid, liquid, gaseous or plasmatic. It is preferably provided as droplets (solid, i.e., frozen, or liquid), as a jet (liquid or gaseous), as a mist or molecular jet. The most suitable materials are tin and xenon as broadband emitters and oxygen and lithium as narrow-band line emitters. By selecting the temperature, these materials can be used as solids, liquids or vapor through the use of cryotechnics or heat technique. Further, chemical compounds with a high proportion of these elements are possible. The physical characteristics of the compounds can appreciably simplify handling of the elements (e.g., water instead of liquid oxygen).

This example is distinguished by the elaborate control of the plasma generation interacting with constant laser excitation through the laser module 36 and moving, mass-limited targets supplied by the target generator module 39.

For this purpose, the main control unit 6 uses the signals of the energy monitor unit 4 and the radiation diagnosis unit 5. When these signals deviate from the application-specific presets, the characteristics of the laser module 36 and target generator module 39 are modified in such a way that the measured values are again adapted to the presets. An EUV pulse energy that is too low is compensated, e.g., by increasing the laser pulse energy and/or by enlarging the diameter of the target flow in the target generator module 39.

The energy monitor unit 4 and the radiation diagnosis unit 5 are conceived for monitoring the emitted radiation 12 in the same way as in the above-described EUV radiation source based on gas discharge. In the same way, they have data links to the main control unit 6 and to the plasma generation unit 3 and their modules. In this case, the main control unit 6 coordinates the matching of the diameter and size of the target from the target generator module 39 (and their sequence in time in the event that a drop generator is used as is shown schematically in FIG. 4) and the adjustment of laser output (pulse energy), pulse duration, pulse-to-pulse stability, position stability and focus state of the laser beam emitted by the laser module 36.

The vacuum generation unit 2 and its control is carried out in the same way as in the first example. However, control of suitable low pressure is simplified insofar as the supply of work gas is dispensed with and is accordingly limited to a simple pressure regulation.

Figure 5:
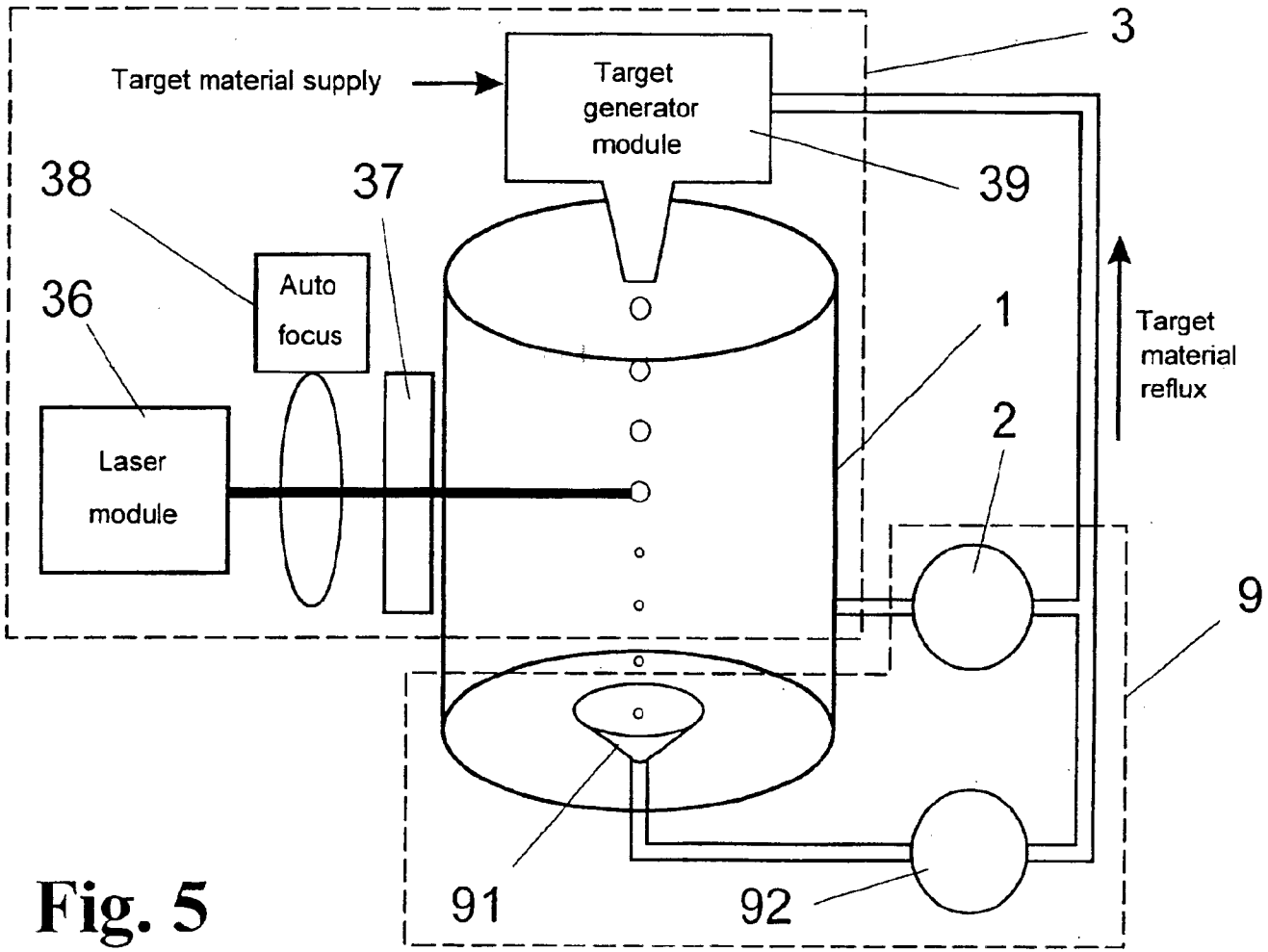
FIG. 5 shows an advisable construction of a target recycling for a laser-based radiation source.

However, the vacuum generation unit 2 can also be incorporated in a target recycling module 9 as is shown in more detail in FIG. 5. Since residues of target material frequently remain in the vacuum chamber 1 in the case of laser bombardment of the target, they can be pumped off and provided again to the target generator module 39. For this purpose, a catch funnel 91 connected to a compressor 92 in the form of a compression pump is incorporated in the surface located opposite from the target generator module 39. The output of the compressor 92 is subsequently joined to the output of the vacuum generation unit 2 and supplied to the target generator module 39. This is useful because substantial proportions of the target material evaporate in the vacuum chamber 1 and are sucked out through the pumps contained in the vacuum generation unit 2 and compressed on the output side at the same time.

The shape of the vacuum chamber 1 in this example is different (than in the construction according to FIG. 2). It is preferably constructed in the shape of a hollow cylinder according to FIG. 4 as is clearly shown in the three-dimensional view in FIG. 5. The target generator module 39 is flanged to a cover surface of the vacuum chamber 1 and the consumed target material is collected at the other cover surface (according to FIG. 5). The laser module 36, the vacuum generation unit 2, the energy monitor unit 4, the radiation diagnosis unit 5 and the outlet opening 13 for coupling out the EUV radiation 12 are arranged peripherally in radial direction at the outer surface of the cylinder. In this specific example, the target generator module 39 generates a droplet flow along the vertical axis of symmetry of the cylindrical vacuum chamber 1. The laser beam generated by the laser module 36 is focused orthogonal to the axis of symmetry on a target flowing past and generates the plasma 11 through the energy input. The outlet opening 13 of the vacuum chamber 1 is located at a suitable angular distance from the direction of incidence of the laser beam. Since the droplet target shown in the drawing emits radiation 12 virtually on all sides, collector optics 8 are located inside the vacuum chamber 1 in this example. The collector optics 8 are arranged at the outer surface of the vacuum chamber 1 opposite from the outlet opening 13 in the form of a curved multilayer mirror. They bundle and focus the radiation 12 from the solid angle of the vacuum chamber 1, which solid angle is located in the rear in relation to the outlet opening 13, and accordingly increase the light yield of desired EUV radiation at the same time.

As was already described in the first example, a debris filter unit 7 is provided in the vacuum unit 1 for retaining particles generated from the plasma 11. This is carried out in order to protect the elements of the application (not shown) arranged following the outlet opening 13 and the collector optics 8 which are arranged in front in this case and also the energy monitor unit 4 and the radiation diagnosis unit 5. A mechanical plate formation is used as a dome-shaped debris filter 72 for the selected construction of the laser-pumped EUV source according to FIG. 4. This dome-shaped debris filter 72 is formed as an active, i.e., rotatable, plate part whose plane plates 73 are arranged between concentric spherical surfaces in such a way that they intersect in the axis of rotation which coincides with the optical axis of the collector optics 8 with respect to the outlet opening 13. Therefore, the radiation 12 exiting from the plasma 11 on all sides is not obstructed and both charged and uncharged particles come into contact with the plates 73 through the rotational movement and are absorbed. The rotational movement for the active dome-shaped debris filter 71 is achieved by means of a tangential drive 74 and is carried out around the optical axis defined by the collector optics 8 and outlet opening 13. This provides for a long service life of the optical components of the EUV radiation source and, at the same time, it is also ensured that the measurement modules according to the invention, the energy monitor unit 4 and the radiation diagnosis unit 5, can perform their measurement tasks for a stable regulation of the radiation output of the EUV source reliably over a long period of time.

While the foregoing description and drawings represent the present invention, it will be obvious to those skilled in the art that various changes may be made therein without departing from the true spirit and scope of the present invention.

Reference Numbers:

1 vacuum chamber
11 plasma
12 radiation
13 outlet opening
14 disk valves
2 vacuum generation unit
3 plasma generation unit
31 discharge module
32 electrodes
33 high-voltage module
34 insulator tube
35 gas supply module
36 laser module
37 beam diagnosis module
38 focusing device
39 target generator module
4 energy monitor unit
41 detector
42 recalibrating detector
5 radiation diagnosis unit
51 spectrograph
52 energy detector
53 (spectrally selective) sensors
54 filter
55 evaluating module
56 EUV camera
57 imaging optics
58 fast EUV detector
6 main control unit
7 debris filter unit
71 flow filter
72 dome-shaped debris filter
73 plates
74 tangential drive
8 collector optics
9 target recycling module
91 collecting funnel
92 compressor
93 gas recycling module

What is claimed is:

1. A radiation source for generating extreme ultraviolet (EUV) radiation, wherein a hot plasma emitting the desired radiation is generated in a vacuum chamber, comprising:

a plasma generation unit which is directly connected with the vacuum chamber for introducing high energy input which is supplied in a pulsed manner in order to generate hot plasma in a small spatial extension and with high density in a vacuum chamber;

said vacuum chamber having an outlet opening for coupling out a light bundle for a specific application;

a vacuum generation unit for generating a diluted gas atmosphere at defined pressure in the vacuum chamber and portions of the plasma generation unit;

said vacuum generation unit furthermore having at least one vacuum pump, a pressure measuring device and a control for maintaining a suitable operating pressure for the generation of the plasma and EUV radiation, and an energy monitor unit for detecting the pulse energy of the emitted radiation;

said energy monitor unit having a feedback to the energy input for regulating a pulse-to-pulse stability of the energy emission of the plasma, a radiation diagnosis unit for analyzing the actual radiation characteristic of the radiation emitted from the plasma and generating result data of the diagnosis for influencing the excitation conditions for the plasma, and a main control unit for controlling a defined quality of the coupled out light bundle as radiation pulses of application-specific pulse repetition rate, average energy emission and radiation intensity;

said main control unit having interfaces to said units of the radiation source in order to detect at least their state of adjustment; and operator controls being provided for application-specific control in order to influence the radiation source depending upon transmitted status data, diagnosis data and application requirements that are entered.

2. The radiation source according to claim 1, wherein the energy monitor unit (4) has a detector for determining the EUV pulse energy for every individual pulse.

3. The radiation source according to claim 2, wherein the energy monitor unit has a second detector for determining the absolute EUV pulse energy which is illuminated only occasionally for comparison measurements in relation to the emitted radiation and for calibrating the first detector.

4. The radiation source according to claim 1, wherein the radiation diagnosis unit as a spectrograph for determining the spectral distribution of the emitted radiation.

5. The radiation source according to claim 4, wherein the spectrograph contains a calibrated detector for determining the output energy or power of the EUV radiation source.

6. The radiation source according to claim 1, wherein the radiation diagnosis unit has a plurality of sensors of different spectral sensitivity, the light yield being measured in defined spectral intervals.

7. The radiation source according to claim 6, wherein the radiation diagnosis unit has a plurality of sensors with different filters, wherein the light yield can be measured in defined spectral intervals by differentiation of measured intensity values of different sensors.

8. The radiation source according to claim 7, wherein the radiation diagnosis unit has means for comparing the measured radiation components within the desired EUV spectral region and outside this range, wherein the quality of the plasma can be analyzed and adjustment variables for the plasma generation unit can be derived by comparing the intensity values of individual spectral intervals to one another.

9. The radiation source according to claim 1, wherein the radiation diagnosis unit has an EUV-sensitive camera for determining the size and position of the source location of the radiation in the plasma.

10. The radiation source according to claim 9, wherein the radiation diagnosis unit contains an imaging optical system, preferably a reflecting multilayer mirror system, for determining the angular distribution of the EUV radiation which is generated by the plasma and exits from the vacuum chamber.

11. The radiation source according to claim 1, wherein the radiation diagnosis unit has a fast EUV detector with response times of a few nanoseconds or less for determining the pulse shape of the emitted radiation.

12. The radiation source according to claim 11, wherein at least one additional fast EUV detector is provided for purposes of recalibrating the first fast EUV detector.

13. The radiation source according to claim 1, wherein the plasma generation unit contains a high-voltage module for generating a high voltage for gas discharge and a discharge module with electrodes that are suitably shaped for a through-flow of gas, wherein a pulsed application of voltage to the electrodes is provided as energy input for plasma generation, and has a gas supply module for the flow of gas through the electrodes which provides a work gas in the vacuum chamber in a suitable composition for plasma generation.

14. The radiation source according to claim 13, wherein the high-voltage module has a capacitor bank which can be charged in a small amount of time and discharged by means of a switching element and an electric circuit via the electrodes of the discharge module.

15. The radiation source according to claim 14, wherein magnetic compression stages for reducing current rise times and additional capacitor banks are integrated in the high-voltage module.

16. The radiation source according to claim 13, wherein the high-voltage module communicates with the main control unit with respect to voltage and charging speed, wherein a triggering of the high-voltage module, particularly the switching element, is provided for determining the time of discharge by means of an external signal of the main control unit.

17. The radiation source according to claim 13, wherein a gas recycling module which is connected to the vacuum generation unit for receiving and delivering gas pumped out of the vacuum chamber communicates with the gas supply module.

18. The radiation source according to claim 13, wherein the discharge module has two concentrically arranged electrodes which are separated from one another by an insulator disk for a plasma focus discharge.

19. The radiation source according to claim 13, wherein the discharge module has two oppositely located electrodes for a Z-pinch discharge which are separated by an insulator tube.

20. The radiation source according to claim 19, wherein the discharge module has a Z-pinch construction which is modified for a capillary discharge, wherein the inner diameter of the insulator tube is very small.

21. The radiation source according to claim 13, wherein the discharge module contains two oppositely located electrodes, wherein the cathode has a cavity in which the plasma ignition takes place for hollow cathode triggered pinch discharge.

22. The radiation source according to claim 1, wherein the plasma generation unit has a laser module by which the plasma is generated by laser bombardment of a target in the vacuum chamber, wherein the laser module is outfitted with control components for self-regulation of the laser based on a laser beam diagnosis, and has a controllable target generator module which is provided for generating a target flow for the laser bombardment that is defined with respect to aggregate state, temperature and shape.

23. The radiation source according to claim 22, wherein a radiation diagnosis module which contains a device for measuring the output energy and pulse energy of the laser beam is associated with the laser module.

24. The radiation source according to claim 22, wherein a focusing device for the laser beam, particularly an autofocus device, is associated with the laser module.

25. The radiation source according to claim 22, wherein collector optics for bundling the radiation emitted from the plasma are arranged in the vacuum chamber, wherein the collector optics comprise a curved multilayer mirror and are arranged in such a way that the usable intensity of the light bundle exiting from the outlet window is increased.

26. The radiation source according to claim 1, wherein a debris filter unit is provided for absorption of particles that are emitted from the plasma with the desired radiation, wherein the debris filter is arranged between the plasma and optical elements of collector optics which are provided for shaping and bundling the radiation exiting from the outlet opening of the vacuum chamber.

27. The radiation source according to claim 22, wherein the vacuum generation unit is incorporated in a target recycling module, wherein a collecting device for target residues which are sucked out via compressors is arranged in the vacuum chamber opposite the target generator module and the outputs of the compressors and vacuum generation unit are connected to the target generator module.

28. The radiation source according to claim 1, wherein the vacuum generation unit has a link to the main control unit by which an adjustment of the required pressure is provided for the plasma generation in the vacuum chamber.

29. The radiation source according to claim 1, wherein the main control unit contains all controls and regulation for all units and modules, wherein corresponding data interfaces are provided for transferring measurement values and adjusting values in order to monitor all functions and states of the radiation source and control them in a coordinated manner.

30. The radiation source according to claim 1, wherein the main control unit provides only application-oriented control functions for the units and modules of the radiation source and has means for monitoring damage and disturbance, wherein all units and modules contain their own control systems and regulation systems which have data communication with the main control unit.

* * * * *

UNITED STATES PATENT AND TRADEMARK OFFICE

CERTIFICATE OF CORRECTION

PATENT NO. : 6,882,704 B2
DATED : April 19, 2005
INVENTOR(S) : Guido Schriever et al.

It is certified that error appears in the above-identified patent and that said Letters Patent is hereby corrected as shown below:

Title page,
Item [73], Assignee, should read -- XTREME technologies GmbH, Jena (DE) --.

Signed and Sealed this

Twenty-third Day of August, 2005

JON W. DUDAS
*Director of the United States Patent and Trademark Office*